United States Patent [19]

Kurosaki

[11] Patent Number: 4,657,291

[45] Date of Patent: Apr. 14, 1987

[54] LOCKING DEVICE

[75] Inventor: Mutsuo Kurosaki, Yawata, Japan

[73] Assignee: Nifco, Inc., Yokohama, Japan

[21] Appl. No.: 853,845

[22] Filed: Apr. 18, 1986

[30] Foreign Application Priority Data

Apr. 24, 1985 [JP] Japan ..... 60-60273[U]

[51] Int. Cl.[4] ..... E05C 13/02

[52] U.S. Cl. ..... 292/6; 292/DIG. 4

[58] Field of Search ..... 292/DIG. 4, DIG. 38, 292/DIG. 72, 5, 6, 45, 129, 170, 179, 191, 192, 198, 229; 24/645, 654, 656, 662

[56] References Cited

U.S. PATENT DOCUMENTS

| | | | |
|---|---|---|---|
| 4,270,781 | 6/1981 | Nishimura | 292/DIG. 4 X |
| 4,383,707 | 5/1983 | Nishimura | 292/DIG. 4 X |
| 4,482,175 | 11/1984 | Sugie | 292/DIG. 4 X |
| 4,538,844 | 9/1985 | Watanabe | 292/DIG. 4 X |

FOREIGN PATENT DOCUMENTS

| | | | |
|---|---|---|---|
| 60-11977 | 1/1985 | Japan . | |
| 208163 | 4/1940 | Switzerland | 292/DIG. 4 |

*Primary Examiner*—Richard E. Moore

*Attorney, Agent, or Firm*—Trexler, Bushnell & Wolters, Ltd.

[57] ABSTRACT

A locking device is disclosed, which is locked when a spike secured to the back surface of a door is pushed once and is released when the spike is pushed once again. The locking device comprises a case open at one end and having a wall provided with a spring portion having an end projection, a lock member slidably accommodated in the case for movement away from and toward the open end and having a pair of locking pawls, a spring for urging the lock member toward the open end of the case at all times, and a cam member provided between the lock member and an end wall of the case and having a lateral ridge formed on one surface and received in a lateral groove of the lock member, the cam member being provided on the other surface with a uni-directional looped path, the projection of the case being slidably engaged in the path. When the lock member is pushed, the projection of the base is caused to trace the looped path to bring about a locked state and an unlocked state.

5 Claims, 19 Drawing Figures

LOCKING DEVICE

FIELD OF THE INVENTION AND RELATED ART STATEMENT

This invention relates to a locking device which can be advantageously used for locking a hinged door or the like in a closed state and, more particularly, to a locking device which is locked when a spike or like member provided on the door is pushed once and is released to permit the opening of the door when the spike is pushed once again.

There is well known a locking device which is operable by pushing it twice in the same direction and in which locked state is obtained when it is pushed for the first time and the locked state is released when it is pushed again.

For this type of locking device several different structures have been proposed. Typical among these structures are one which makes use of a rotary cam member, and one of heart-shaped groove type in which a lock pin having a spring function is engaged in a unidirectional heart-shaped groove.

The former locking device comprises a case and a slide slidably accommodated in the case. The slide rotatably supports an oval rotary cam member having two engagement sections. The rotary cam member has the same length as the slide. When the slide is pushed into the case for the first time, a projection provided on the case strikes a notch-like engagement section provided at the front end of the cam member and slightly turns the cam member to cause slight lateral deviation of another notch-like engagement section provided at the rear end of the cam member. When the slide is subsequently returned by the spring force, the engagement section at the rear end is engaged with a locking section provided on the case to bring about a locked state preventing the return of the slide. When the slide is subsequently pushed again into the case, the projection again strikes the engagement section at the front end again and slightly turns the cam member, thus releasing the engagement section at the rear end to release the lock. During this time, the rotary cam member is turned by one half rotation.

The latter locking device comprises a cam member formed with a heart-shaped groove and a locking pin having a spring function and slidably engaged in the groove. The heart-shaped groove constitutes a unidirectional path consisting of a plurality of inclined bottom sections and stepped sections. The locking pin is urged against the bottom of the path. When the slide is pushed for the first time, the locking pin is led along the groove to the valley portion of the heart and engaged therein. Thus, a locked state is obtained. When the slide is subsequently further pushed, the locking pin is detached from the valley portion and returned to the initial position to release the lock.

These two different types of devices are both in practical use. In the former device, slight rotation of the rotary cam member is induced to effect engagement of the engagement section so as to obtain the locked state, and the locked state is released with slight rotation. Therefore, high precision is required of the positional relation among the various parts. Particularly, it is extremely difficult to manufacture a small device because in this case even very slight manufacturing errors lead to erroneous operation. Further, with the locking device of the rotary cam type, no click is obtained at the time of the operation. Therefore, the user has to confirm the operation visually.

In the latter locking device which is of the heart-shaped groove type, the locking pin slidably engaged in the groove rides along the inclined bottom of the groove to fall in a stepped section. At this time, the end of the locking pin strikes the bottom of the groove with a click. Therefore, a click is reliably obtained when the locked state is obtained with the engagement of the locking pin in the valley portion of the heart and also when the lock is released with the detachment of the pin from the valley. However, the prior art locking device of the heart-shaped groove type is complicated in construction because the locking pin is operated in a complicated fashion. This drawback becomes particularly serious when reducing the size of the device.

More specifically, during operation the end of the locking pin slidably engaged in the heart-shaped groove executes swinging operation in lateral directions along the shape of the heart while at the same time it is moved vertically in conformity with the inclined bottom and steps of the groove as it is held in forced frictional contact with the bottom of the groove by the spring force. Therefore, the locking pin has to be made of a copper wire or like material having high mechanical strength with respect to swinging. Further, it is necessary to provide separate means for urging the locking pin against the bottom of the groove with a spring force. Therefore, the assembly of the components is troublesome. In addition, the number of components is large, which is undesirable from the standpoint of size reduction.

OBJECT AND SUMMARY OF THE INVENTION

The invention was made in the light of the above drawbacks of the prior art locking device, and its object is to provide a locking device in which the lateral swinging motion along the shape of the heart and vertical movement in conformity with the slope and step of the bottom of the heart-shaped groove that are executed by a single locking pin having a spring function in the prior art device are performed by separate means. More specifically, the invention seeks to provide a locking device in which a projection provided at the end of a spring portion corresponding to the locking pin is caused to perform only a vertical motion in conformity with the slope and step of the bottom of a heart-shaped path, while a cam member formed with a heart-shaped path is caused to perform lateral movement as the lateral swinging motion in conformity with the shape of the heart, so that the two motions in different directions are performed by separate means to simplify the motions, facilitate the manufacture and increase the precision.

To attain the above object of the invention, there is provided a locking device which is locked when a spike is pushed once and is unlocked when the spike is pushed once again, and which comprises a case open at one end and having a wall provided with a spring portion having an end projection, a lock member slidably accommodated in the case for movement away from and toward the open end and having a pair of locking pawls, a spring for urging the lock member toward the open end of the case at all times, and a cam member provided between the lock member and an end wall of the case and having a lateral ridge formed on one surface and received in a lateral groove of the lock member, the cam member being provided on the other surface with a uni-directional looped path, the projection of the case being slidably engaged in the path. When the spike is pushed once, the lock member is retracted into the case against the biasing force of the spring so that the spike is hooked between the locking pawls while the projection of the spring portion is moved along the uni-directional looped path into engagement in an intermediate engagement section of the path to bring about a locked state. When the spike is pushed once again, the engagement of the projection is released to cause the lock member to proceed toward the open end of the case to recover the initial state while releasing the spike from the locking pawls, thereby releasing the lock.

The uni-directional looped path provided on the other surface of the cam member surrounds a substantially heart-shaped raised portion provided substantially in a central portion of the other surface and includes a first upwardly inclined bottom section extending from a rear edge of the cam member to one side of the raised portion, a first stepped section extending from the first upwardly inclined bottom section, an engagement section extending from the first stepped section, a second upwardly inclined bottom section extending from the engagement section and having a small length, a second stepped section extending from the second upwardly inclined bottom section, and a third upwardly inclined bottom section extending from the second stepped section along the opposite side of the raised portion up to the rear edge, and also the cam member has a position recovery guide projection provided on the outer side of the end of the third upwardly inclined bottom section for returning the cam member to a central position.

When the spike strikes and pushes the lock member accommodated in the case, the locking pawls hook the spike and at the same time the lock member is retracted into the case against the spring. With this retraction, the projection provided on the spring portion of the case rides on the first upwardly inclined bottom section of the cam member against the spring force. When the projection subsequently comes to the first stepped section, it clickingly falls into this section. When the pushing force on the lock member is released upon reaching the deepest portion, the projection is led out of the first stepped section to be engaged in the intermediate engagement section of the path as the lock member is pushed toward the open end of the case by the biasing force of the spring. At this time, the cam member is once moved to one side along the guide groove of the lock member and then returned to the central portion of the lock member to align the engagement section to the position of the projection provided at the central position.

When the lock member is further pushed and retracted by the spike from this state, i.e. the locked state, the projection proceeds from the second upwardly inclined bottom section to the second stepped section and clears the second stepped section with a clicking sound. When the urging force is released at this moment, the projection is returned along the third upwardly inclined bottom section of the path to the inlet of the first upwardly inclined bottom section as the rear edge of the cam member with the lock member is forced toward the open end of the case by the biasing force of the spring. The locked state of the lock member is thus released. At the same time, the locked state of the spike by the locking pawls is released. The door or the like provided with the spike is thus released, and the lock member is ready for the next locking action.

At this time, with the movement of the projection along the third upwardly inclined bottom section, the guide member is returned to the central position with the guide groove of the lock member as a guide to be ready for being pushed.

The above and other objects, characteristic features and advantages of the present invention will become apparent to those skilled in the art as the disclosure is made in the following description of a preferred embodiment of the invention, as illustrated in the accompanying drawings.

BRIEF DESCRIPTION OF THE DRAWINGS

FIGS. 15 to 19 are sectional views illustrating the function of the locking device, in which:

FIG. 15 shows the device in a released state before a spike member is engaged;

FIG. 16 shows the device in a state in which the spike member is brought into engagement with an engagement end of the lock member and pushed into the case;

FIG. 17 shows the device in a locked state;

FIG. 18 shows the device in a state immediately after a protuberance is detached from an engagement section by pushing again the spike member; and FIG. 19 shows the device in a state in which urging force is released from the spike member to release the locked state.

DETAILED DESCRIPTION OF THE PREFERRED EMBODIMENT

Figure 1:
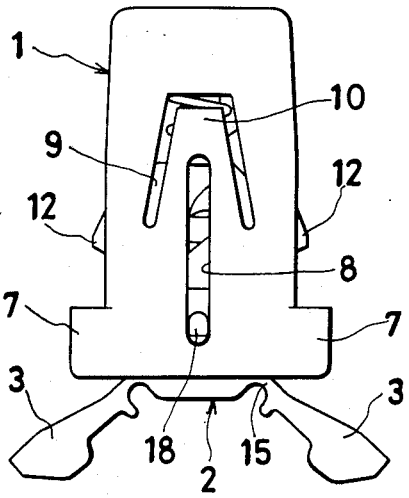
FIG. 1 is a plan view showing an embodiment of the locking device according to the invention.
Figure 2:
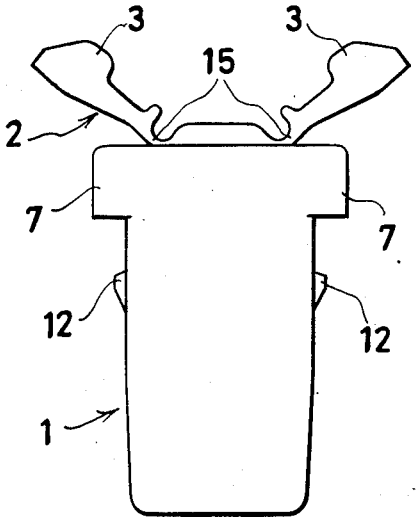
FIG. 2 is a bottom view of the device.
Figure 3:
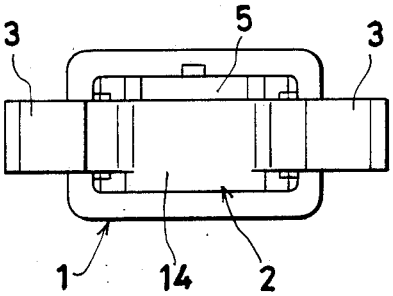
FIG. 3 is a front view of the device.
Figure 4:
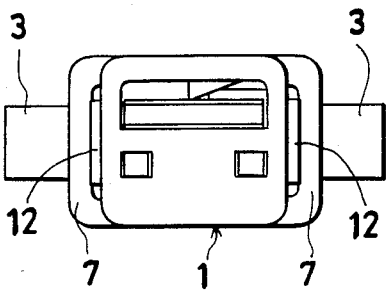
FIG. 4 is a rear view of the device.
Figure 5:
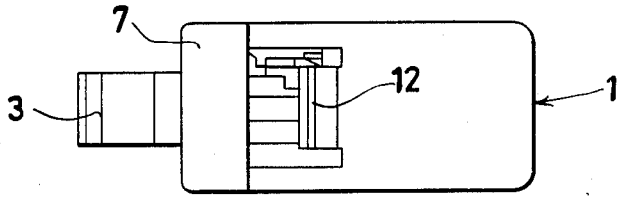
FIG. 5 is a right side view of the device.
Figure 6:
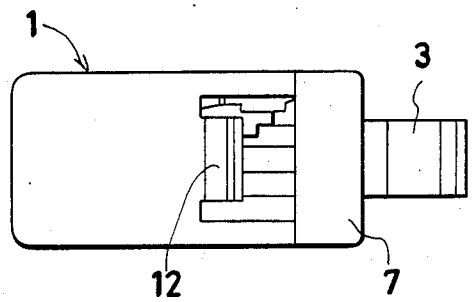
FIG. 6 is a left side view of the device.
Figure 9:
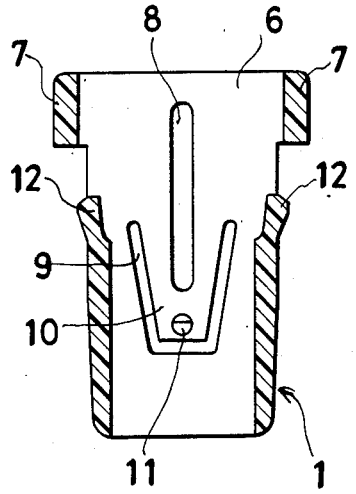
FIG. 9 is a sectional view showing the bottom of an upper portion of a case.
Figure 7:
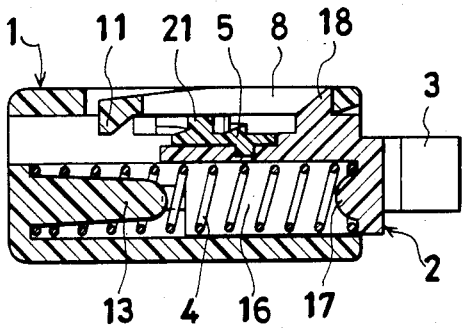
FIG. 7 is a longitudinal sectional view of the same.
Figure 10:
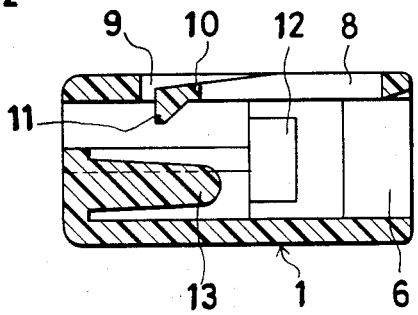
FIG. 10 is a longitudinal sectional view showing the case.
Figure 8:
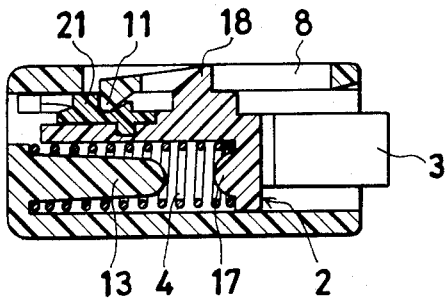
FIG. 8 is a view similar to FIG. 7 but showing the device in a locked state.
Figure 11:
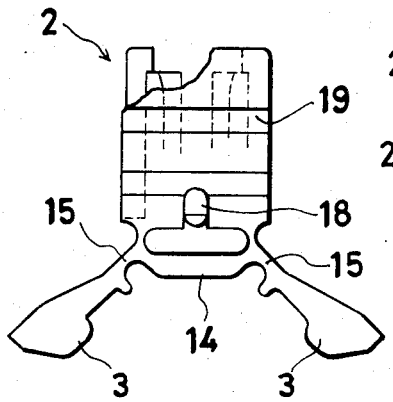
FIG. 11 is a plan view, partly broken away, showing a lock member.

Now, the present invention will be described in conjunction with the illustrated embodiment thereof. The illustrated embodiment of the invention is applied to a device for locking a door.

The illustrated locking device according to the invention comprises a case 1, a lock member 2, a spring 4 and a cam member 5. The lock member 2 is slidably accommodated in the case 1. In this embodiment, it has a pair of locking pawls 3. The spring 4 biases the lock member 2 toward an open end of the case 1. The cam member 5 is provided between the case 1 and lock member 2 accommodated therein. It controls the locking state of the pair of locking pawls 3 to restrict the movement of the lock member 2. In the illustrated embodiment, all the components except for the spring 4 are made as independent moldings of a thermoplastic synthetic resin, e.g. nylon.

The case 1 has a box-like shape with an open end 6. It has outer flanges 7 formed on opposite sides of the open end 6. Its upper wall is formed with a longitudinal guide slot 8 which extends centrally of the upper wall from a position near the open end 6. The upper wall is also formed in a central portion with a substantially V-shaped notch 9 which does not cross the slot 8. The notch 9 defines a spring portion 10. The free end of the spring portion 10 is provided with an inward projection 11.

The inward projection 11 is received in and moves along a looped path formed in the cam member 5 to be described later. The end of the projection 11 has two surfaces. One of these end surfaces is adapted to strike the bottom of the looped path of the cam member 5 with a large clicking sound as the projection 11 is moved along the path having various bottom levels in a state urged against the bottom by the spring portion 10.

The case 1 has outwardly projecting pawls 12 formed on the opposite sides. These pawls 12 face the respective flanges 7. The case 1 also has a rod-like spring retainer 13 projecting from the inner surface of the end wall toward the open end 6. The spring 4 is fitted on the spring retainer 13.

The lock member 2 is in the form of a block having an engagement end 14. It has a pair of locking pawls 3 united by reduced thickness hinge portions 15 to the opposite sides of the engagement end of the main block portion. The main block portion has a cavity 16 open at the rear end and having a substantially circular sectional profile. The bottom of the cavity 16 is provided with a spring retainer 17.

The lock member 2 has a central protuberance 18 formed on the top surface near the engagement end 14. It also has a lateral straight guide groove 19 formed in the top surface and rearwardly of the protuberance 18.

The cam member 5 is a rectangular plate-like member. It has a lateral ridge 20 formed on the underside and adapted to be slidably received in the guide groove 19 formed in the lock member 2. It also has a substantially heart-shaped raised portion 21 formed in a central portion of its top. It further has a looped path 22 surrounding the heart-shaped edges of the raised portion.

Figure 12:
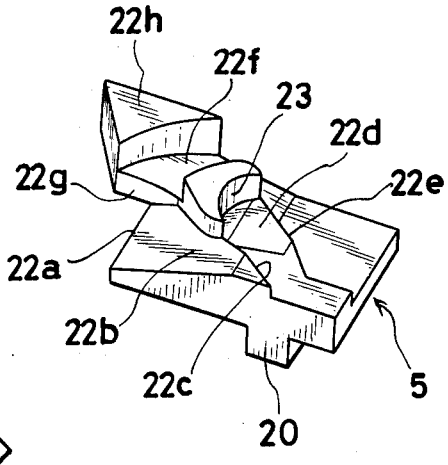
FIG. 12 is an enlarged perspective view showing a cam member.
Figure 13:
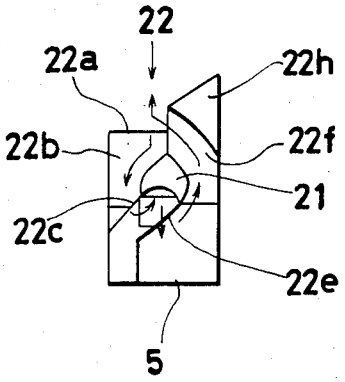
FIG. 13 is a plan view showing the cam member.
Figure 14:
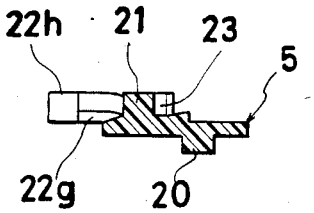
FIG. 14 is a longitudinal sectional view showing the cam member.

The inward projection 11 provided at the free end of the spring portion of the case 1 is received in the looped path 22 for movement along this path in a fixed direction. As the projection 11 is guided along the path 22, the locking pawls 3 of the lock member 2 are brought to a locking state, or this locking state is released. The looped path 22 is illustrated in detail in FIGS. 12 to 14. More specifically, it includes a receiving section **22*a* for receiving the projection 11, a first upwardly inclined bottom section 22*b* extending from the section 22*a* along one side of the heart-shaped raised portion 21, a first stepped section 22*c* extending from the section 22*b*, and an engagement section 23 extending from the section 22*c* along the valley-like edge of the heart-shaped raised portion. The path further includes a second upwardly inclined bottom section 22*d* extending from the section 23, a second stepped section 22*e* extending from the section 22*d*, a long upwardly inclined bottom section 22*f* extending from the stepped section 22*e* along the opposite side of the heart-shaped raised portion 21, and a third stepped section 22*g* extending from the section 22*f* and terminating in the receiving section 22*a*. The looped path 22 includes inclined bottom sections and stepped sections alternately, so that the projection 11 of the spring portion 10 can proceed along the path only in one direction, i.e., the direction shown by arrows in FIG. 13 and can be engaged in and released from the engagement section 23 of the path. Designated by 22*h* is a substantially triangular, position recovery guide projection for returning the projection 11 from an intermediate portion of the upwardly inclined bottom section 22*f* to the receiving section 22*a***.

The cam member 5 which has the uni-directional looped path 22 formed on one surface, is assembled by inserting it in a state set on top of the lock member 2 into the case 1 from the open end 6 thereof. FIGS. 1 to 7 show the device in the assembled state.

The assembly of the locking device will be described in further detail. The cam member 5 is first set on top of the lock member 2 and assembled by fitting the lateral ridge 20 in the lateral guide groove 19. Then, the spring 4 in the form of a coil is fitted in the cavity 16, with its one end fitted on the retainer 17. The lock member with the cam member and spring assembled therein is inserted into the case 1 from the open end 6 thereof, thus fitting an end portion of the spring 4 on the rod-like spring retainer 13 provided in the case. In this way, the spring retainer 13 is received in the cavity 16, and the entire lock member is forced into the case.

At this time, the projection 18 on top of the lock member engages with the upper wall of the case 1 adjacent to the open end 6. However, the lock member is forcibly inserted by raising the upper wall of the case by making use of the elasticity of the material of the case. As a result, the projection 18 is received in the longitudinal guide slot 8 provided in the upper wall of the case, and the raised upper surface of the case is restored. Now, detachment of the lock member 2 is prevented.

The lock member 2 which is accommodated in the case in this way, is normally urged toward the open end 6 of the case by the spring 4 accommodated in a compressed state in the case. The projection 18 is thus held in engagement with one end of the guide slot 8. In this state, the engagement end 14 is flush with the open end 6, and the locking pawls 3 project in an open state from the open end 6.

When using the locking device according to the invention with the lock member 2 and cam member 5 accommodated in the case 1 as a locking device for a door, the device is mounted on the edge of an opening of a cabinet or the like, to which a door is hinged, and a spike provided at a corresponding position of the back side of the door is trapped between the pair of locking pawls 3 to hold the door closed.

FIGS. 16 to 19 illustrate the function of the locking device having the above construction according to the invention.

When using the locking device according to the invention as a locking device for a door, a panel 24 defining an opening of a cabinet or the like, to which a door is hinged, is formed with a mounting hole 25, and the case 1 is inserted through the hole 25 from the front side. The hole 25 is formed such that it has a front side increased diameter portion, in which the opposite side outer flanges 7 provided on the case 1 adjacent to the open end 6 thereof are received. At this time, the pawls 12 provided on the opposite sides of the case are adapted to clear the hole 25. As a result, the edge of the hole 25 is clamped between the flanges 7 and pawls 12. Meanwhile, a spike 27 having an increased diameter end is mounted on the corresponding position of the back surface of the door 26.

Figure 15:
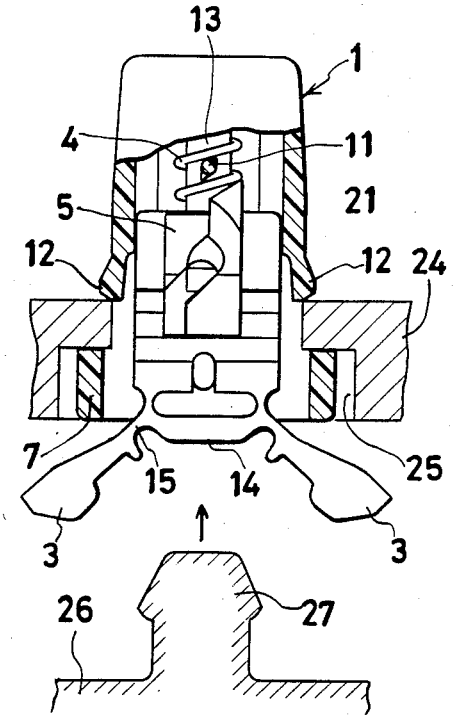

FIG. 15 shows the locking device mounted on the panel and in a stage before locking the door. The engagement end 14 of the lock member 2 is aligned to the open end 6 of the case 1, and the two locking pawls 3 extending from this end are in an open state ready to receive the spike 27.

When the spike 27 is advanced in this state, its end eventually strikes and pushes the engagement end 14 of the lock member 2. The lock member 2 thus is pushed into the case 1 by compressing the spring 4. In consequence, the two locking pawls 3 having been in the open state on the outer side of the open end 6 of the case are closed toward each other as they pass through the open end 6 to engage and embrace the increased diameter end of the spike 27.

Figure 16:
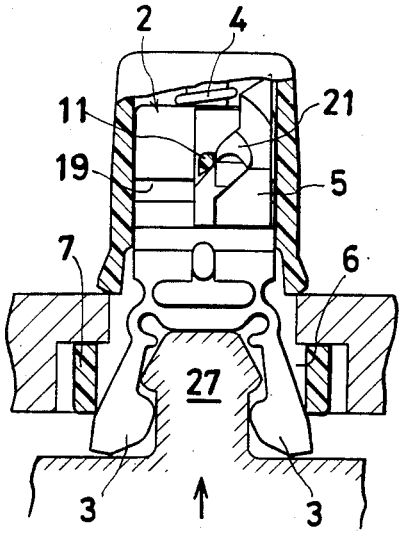

FIG. 16 shows the device in this state. With the retraction of the lock member 2 at this time, the cam member 5 on the lock member 2 proceeds into the depth of the case, and the inward projection 11 of the spring portion 10 of the upper wall of the case eventually reaches the receiving section **22*a* of the heart-shaped looped path 22. As the cam member 5 is further forced inwardly with the lock member 2, the projection 11 rides on the first upwardly inclined bottom section 22*b* and deeply protrudes into the central portion of the cam member 5 along one side of the heart-shaped raised portion 21**.

As the projection 11 rides on and proceeds along the upwardly inclined bottom section **22*b* of the path, the projection 11 rises along the inclined surface with the flexing of the spring 10. At this time, however, there is no lateral movement. Therefore, with the engagement of the projection 11 with the inclined side edge of the heart-shaped raised portion 21, the cam member 5 itself is moved in an upper rightward direction in the Figure with the ridge 20 in slidable engagement with the guide groove 19 of the lock member as a guide, thus permitting the projection 11 to ride on the upwardly inclined bottom of the path. FIG. 16** accurately shows the device in this state.

Figure 17:
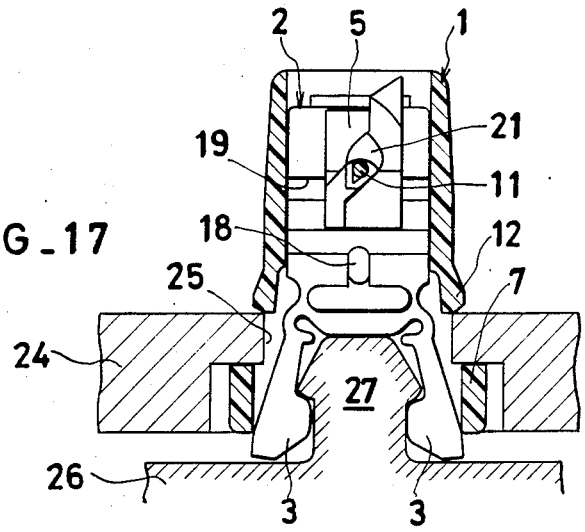

When the lock member 2 is further pushed from the above state, the locking pawls 3 completely enter the case 1, so that the spike 27 is completely held embraced. FIG. 17 shows this state. The projection 11 having entered the path 22 of the cam member 5 proceeds along the first stepped section **22*c* to be eventually engaged in the engagement section 23 which is formed along the valley-shaped edge of the raised portion 21**.

When the stepped portion **22*c* is cleared by the projection 11, the lock member 2 reaches the deepest part of the case 1 so that it can no further be pushed into the case. When the pushing force applied to the lock member is released at this time, the lock member 2 is returned by the biasing force of the spring 4. The projection 11 is thus guided along the stepped section 22*c* so that it is automatically engaged in the engagement section 23. At this time, the cam member 5 is again moved laterally with respect to the central portion of the top of the lock member 2 with the guide groove 19** as a guide.

FIG. 17 shows the device in the locked state, in which the door 26 is held closed.

To open the door again, the surface of the door is pushed, thus pushing the spike 27 against the lock member 2. As a result, the lock is released, so that the door can be opened.

Figure 18:
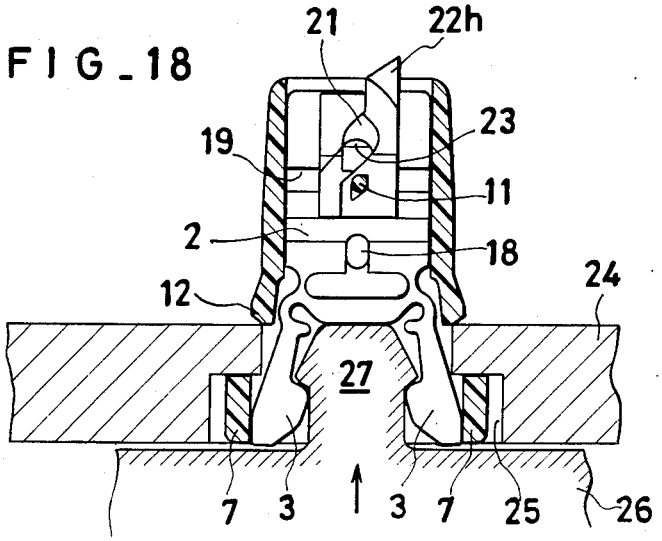
Figure 19:
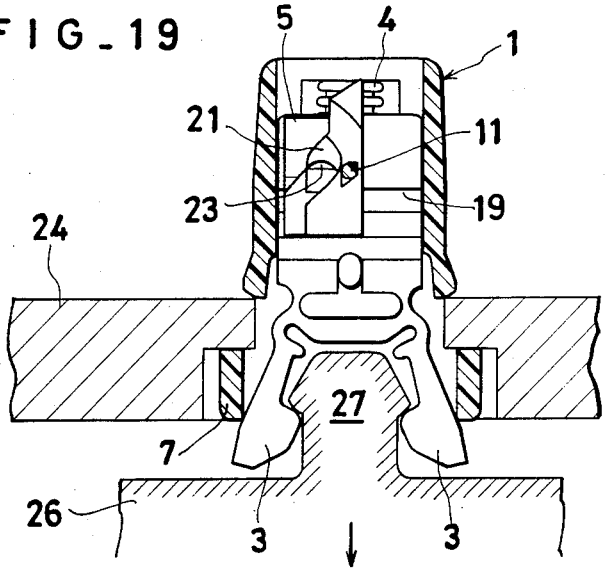

FIG. 18 shows the device in a state in which the spike 27 is pushed again for releasing the lock. FIG. 19 shows the device in a state in which the spike 27 is released to detach the projection 11 from the path 22 of the cam member.

When the spike 27 is pushed to release the lock, the lock member is moved away from the open end 6 of the case. Thus, the projection 11 engaged in the engagement section 23 rides on the second upwardly inclined bottom section **22*d* by causing upward flexing of the spring portion 10. Then it falls into the stepped section 22*e***.

As soon as the projection 11 falls into the stepped section **22*e*, the end of the lock member 2 is brought into contact with the end wall of the case so that the lock member 2 can no further be pushed. When the force urging the spike 27 is released at this time, the lock member 2 is returned toward the open end 6 of the case by the biasing force of the spring 4. The cam member 5, which is assembled with the lock member 2 with the ridge 20 slidably engaged in the guide groove 19, thus also returns toward the open end 6. The projection 11 is moved along the inclined bottom of the stepped section 22*e* to the right side of the heart-shaped raised portion 21. The projection 11 eventually escapes from the raised portion and enters the third inclined bottom section 22*f*. Then it clears the section 22*f* to fall into the stepped section 22*g* and return to the receiving section 22*a***.

When the urging force is released after the projection 11 has fallen into the stepped portion **22*e* (the state shown in FIG. 18), the cam member 5 is moved to the left with the inclined bottom of the stepped portion 22*e* as a guide, so that the projection 11 is detached from the back side of the raised portion 21 (lower side in the Figure). When the projection 11 rides on the inclined bottom section 22*f*, the cam member is brought to the leftmost position to permit the passage of the projection. The projection thus is returned to the receiving section 22*a* (FIG. 19). When the projection 11 escapes from the cam member, the cam member is led again to the position recovery guide projection 22*h*** to return to the central portion of the top of the lock member to be ready for the next locking operation.

With the above construction of the invention, when locking the spike provided on the door, the projection 11 engaged in the path 22 of the cam member 5 is at a fixed position irrespective of the fact that the path 22 is provided along the substantial heart-like shape. Thus, the projection 11, which is at the end of the spring portion 10, proceeds along the alternate inclined bottom and stepped sections of the path to engage in the engagement section 23 to bring about the locked state. Also, when the lock member 2 and cam member 5 are moved away from the open end of the case by the spike pushed again, the projection 11 escapes from the engagement section 23 and proceeds in one direction through the inclined bottom sections and stepped sections of the path to the initial position of the path, thus releasing the lock. At this time, the projection 11 is moved only in the vertical directions by the action of the spring portion 10, so that it is allowed to proceed only in one direction by accurately proceeding along the successive inclined bottom sections and stepped sections. The spread of the path 22 in the width direction along the heart-like shape is absorbed with lateral movement of the cam member 5, with the ridge 20 slidably engaged in the guide groove 19, so that the projection 11 may be displaced only in vertical directions.

Since the projection 11, which is engaged in and moved along the heart-shaped path 22, may be moved only in the vertical directions, it may be provided directly on the spring portion 10 of the case 1 acting like a leaf spring. Thus, it can be readily formed. The cam member 5 which receives the projection 11 has a slightly complicated structure. However, it can be readily formed by extrusion molding of plastics. Thus, it is suited for mass production and can be readily manufactured, so that it can be provided inexpensively.

Of course, in the locking device according to the invention the case 1, lock member 2, cam member 5 and spring 4 are manufactured independently. However, these components can be very easily assembled by setting the cam member 5 on top of the lock member 2 and inserting the lock member into the case from the open end thereof such as to clamp the spring 4 between the lock member 2 and case 1.

The cam member 5 forming the path 22 is substantially in the form of the plate and is assembled in a state in contact with the top of the lock member 2. The projection 11 slidably engaged in the path is provided directly on the spring portion of the wall of the case 1 and does not occupy substantial space, which is very advantageous for size reduction of the entire device. Thus, the locking device according to the invention can be effectively utilized as locking devices for doors of furniture and cabinets of household electric apparatus.

Further, with the locking device according to the invention the spike is locked and released only with the movement of the lock member in the case, lateral movement of the cam member and vertical movement of the projection moved along the path. These individual movements are simple and will not give rise to erroneous operations. Thus, it is possible to obtain a device which is accurate in movement, stable and less subject to troubles or damage.

Further, it is to be noted that with the locking device according to the invention the projection moved along the path during the operation proceeds along the inclined bottom of the path, i.e., the upwardly inclined bottom sections and stepped sections. Whenever the projection proceeds from a section to the next section, it gives a click due to the urging force of the spring portion. Thus, the operation can be confirmed by the sense of touch, which is very convenient.

Further, with the locking device according to the invention the case is provided with flanges and locking pawls, so that the device can be mounted by simply pushing it, which is very convenient for use.

What is claimed is:

1. A locking device, which is locked when a spike is pushed once and is released from the lock when the spike is pushed once again, comprising: a case open at one end and having a wall provided with a spring portion having an end projection; a lock member slidably accommodated in said case for movement away from and toward said open end and having a pair of locking pawls; a spring for urging said lock member toward said open end of said case at all times; and a cam member provided between said lock member and an end wall of said case and having a lateral ridge formed on one surface and received in a lateral groove of the lock member, said cam member being provided on the other surface with a uni-directional looped path, said projection of said case being slidably engaged in said path; wherein when said spike is pushed once said lock member is retracted into said case against the biasing force of said spring so that said spike is hooked between said locking pawls while said projection of said spring portion is moved along said uni-directional looped path into engagement in an intermediate engagement section of said path to bring about a locked state, and when said spike is pushed once again the engagement of said projection is released to cause said lock member to proceed toward said open end of said case to recover the initial state while releasing said spike from said locking pawls, thereby releasing the locked state; said uni-directional looped path provided on said other surface of said cam member surrounding a substantially heart-shaped raised portion provided substantially in a central portion of said other surface and including a first upwardly inclined bottom section extending from a rear edge of said cam member to one side of said raised portion, a first stepped section extending from said first upwardly inclined bottom section, said engagement section extending from said first stepped section, a second upwardly inclined bottom section extending from said engagement section and having a small length, a second stepped section extending from said second upwardly inclined bottom section, and a third upwardly inclined bottom section extending from said second stepped section along the opposite side of said raised portion up to said rear edge, and also said cam member has a position recovery guide projection provided on the outer side of the end of said third upwardly inclined bottom section for returning said cam member to a central position.

2. The locking device according to claim 1, wherein said pair of locking pawls of said lock member are in an open state when they project from said open end of said case and are in a closed state when they are pushed into said case.

3. The locking device according to claim 1, wherein said case has a wall formed with a longitudinal guide slot, and said lock member is provided with a projection slidably received in said guide slot.

4. The locking device according to claim 1 wherein said third upwardly inclined bottom section is long relative to said second upwardly inclined bottom section.

5. The locking device according to claim 4 wherein said third upwardly inclined bottom section is longer than said first upwardly inclined bottom section.

* * * * *